US009611681B2

(12) United States Patent
Reinecke

(10) Patent No.: US 9,611,681 B2
(45) Date of Patent: Apr. 4, 2017

(54) CLOSURE ELEMENT HAVING A JOINT AXIS MECHANISM

(71) Applicant: PR Germany GmbH, Cologne (DE)

(72) Inventor: Peter Reinecke, Numbrecht (DE)

(73) Assignee: PR Germany GmbH, Cologne (DE)

( * ) Notice: Subject to any disclaimer, the term of this patent is extended or adjusted under 35 U.S.C. 154(b) by 0 days.

(21) Appl. No.: 14/896,758

(22) PCT Filed: Apr. 13, 2014

(86) PCT No.: PCT/EP2014/057456
§ 371 (c)(1),
(2) Date: Jan. 13, 2016

(87) PCT Pub. No.: WO2014/167132
PCT Pub. Date: Oct. 16, 2014

(65) Prior Publication Data

US 2016/0168894 A1 Jun. 16, 2016

(30) Foreign Application Priority Data

Apr. 13, 2013 (DE) ..... 10 2013 206 622

(51) Int. Cl.

| | |
|---|---|
| ***H01R 39/00*** | (2006.01) |
| ***E05D 11/00*** | (2006.01) |
| ***E06B 7/28*** | (2006.01) |
| ***F25D 23/02*** | (2006.01) |
| ***H01R 35/04*** | (2006.01) |

(52) U.S. Cl.
CPC ..... *E05D 11/0081* (2013.01); *E06B 7/28* (2013.01); *F25D 23/028* (2013.01); *H01R 35/04* (2013.01); *E05Y 2900/132* (2013.01); *E05Y 2900/31* (2013.01)

(58) Field of Classification Search
CPC ..... H01R 39/00; H01R 39/64; H01R 39/24; H01R 2201/16; H01R 39/08
USPC ..... 439/26, 23, 29, 25, 31, 578
See application file for complete search history.

(56) References Cited

U.S. PATENT DOCUMENTS 1,744,040 A * 1/1930 Elzer ..... E05D 11/0081 174/86
1,950,215 A * 3/1934 Baum ..... H01R 24/58 200/50.28

(Continued)

FOREIGN PATENT DOCUMENTS

CN 1364209 8/2002
CN 1561426 1/2005

(Continued)

OTHER PUBLICATIONS

International Searching Authority,Written Opinion of the International Searching Authority for PCT/EP2014/057456 Jun. 6, 2014.

*Primary Examiner* — Abdullah Riyami
*Assistant Examiner* — Vladimir Imas
(74) *Attorney, Agent, or Firm* — Hodgson Russ LLP

(57) ABSTRACT

The invention relates to a closure element (1) in the form of a window or a door. The invention also relates to a joint axis mechanism (9) for such a closure element. The closure element (1) has a liquid crystal film (5) which is connected to cables (26) that are connected to other cables (22) via sliding contacts of an electrical connecting unit (16).

21 Claims, 3 Drawing Sheets

(56) References Cited

U.S. PATENT DOCUMENTS 2,773,247 A * 12/1956 Erhardt, Jr. ..... H01R 39/00 310/227
2,843,830 A * 7/1958 Blanding ..... G01C 19/10 439/26
3,246,282 A * 4/1966 Mas ..... H01M 2/1022 439/225
3,860,312 A 1/1975 Gordon, Jr.
4,140,357 A * 2/1979 Wolz ..... E05D 11/0081 174/86
4,412,711 A * 11/1983 Suska ..... E05D 11/0081 16/223
4,807,312 A * 2/1989 Baus ..... A47K 3/34 160/195
5,532,807 A * 7/1996 Takemoto ..... G03G 15/2053 219/216
5,657,149 A 8/1997 Buffat
5,810,606 A * 9/1998 Ballast ..... B60R 16/027 385/26
6,063,589 A * 5/2000 Kellogg ..... B01F 13/0059 366/DIG. 3
6,068,490 A * 5/2000 Salzberg ..... H01R 39/64 439/22
6,466,298 B1 10/2002 Fix
6,671,080 B2 * 12/2003 Poll ..... E06B 3/66 359/265
6,805,468 B2 * 10/2004 Itoh ..... G02B 6/0016 362/23.09
7,074,044 B2 * 7/2006 Billing ..... H01R 35/04 439/23
8,607,503 B2 * 12/2013 Ivie ..... E06B 9/04 49/55
8,926,336 B2 * 1/2015 Gobel ..... H01R 24/542 439/13
8,986,017 B2 * 3/2015 Borg ..... H01R 43/14 310/232
9,032,667 B2 * 5/2015 Artwohl ..... F25D 23/02 49/162
9,052,536 B2 * 6/2015 Artwohl ..... A47F 3/0434
9,144,328 B2 * 9/2015 Seeley ..... G06F 3/04886
9,155,405 B2 * 10/2015 Artwohl ..... A47F 3/0434
9,185,357 B2 * 11/2015 Boccara ..... A61B 5/0066
2012/0285089 A1 11/2012 Artwohl et al.

FOREIGN PATENT DOCUMENTS

| | | |
|---|---|---|
| CN | 101084360 | 12/2007 |
| CN | 201991352 | 9/2011 |
| EP | 0575207 | 12/1993 |
| EP | 0825478 | 2/1998 |
| GB | 2182715 | 5/1987 |

* cited by examiner

Fig. 11B
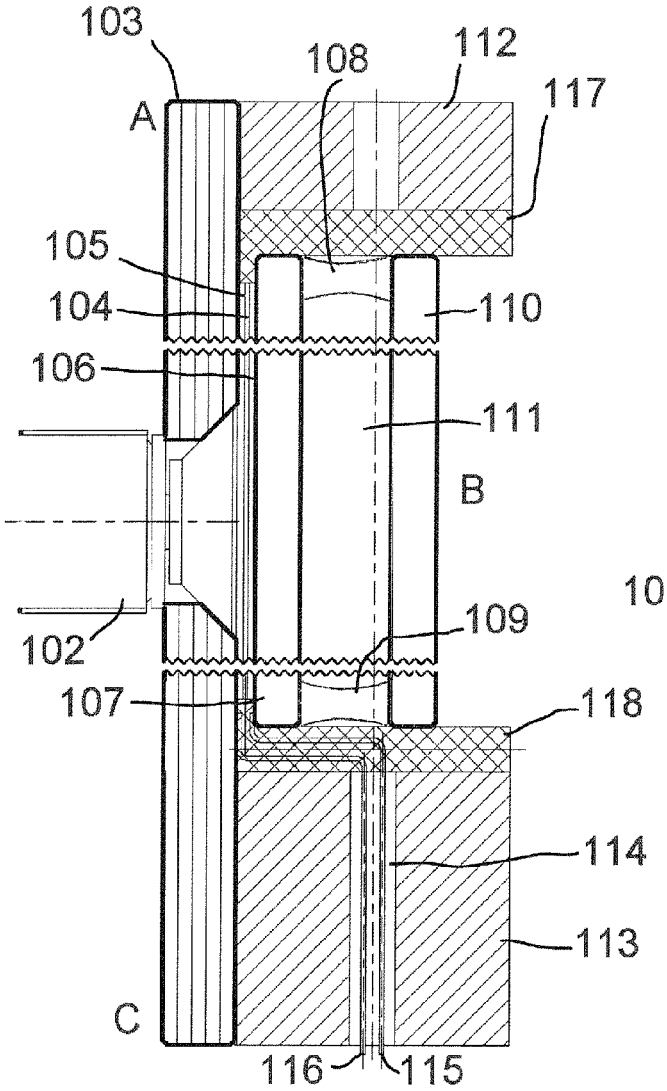
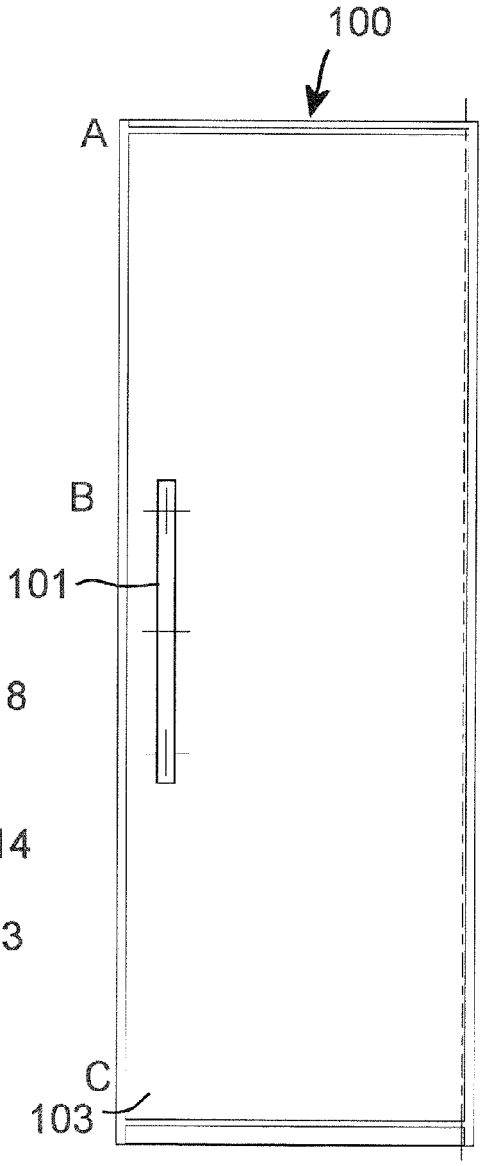
Fig. 11A
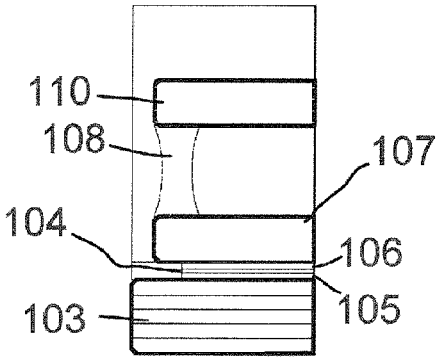
Fig. 11C

CLOSURE ELEMENT HAVING A JOINT AXIS MECHANISM

BACKGROUND OF THE INVENTION

The invention relates to a closure element in the form of a window or a door, in particular a refrigerator door or a door to a building (for example a store). The invention further relates to an articulation axis mechanism for a closure element of this kind.

An LCD screen (liquid-crystal screen), which is used as a computer screen or television screen for example, is known from the prior art. The technology of the LCD screen is based on the principle that liquid crystals influence the direction of polarization of light when a voltage is applied. An LCD screen is divided up into numerous picture elements (pixels), which can be electrically activated. As a result, it is possible to reproduce graphical displays using the LCD screen. In order to display colors, 3 subpixels are used for the primary colors red, green and blue per picture element (pixel).

The use of liquid crystals has in the meantime also found its way into glass element technology. For example, a glass element which is provided with a liquid-crystal film is known from the prior art. The liquid-crystal film is, for example, arranged between a first glass pane and a second glass pane. By applying a voltage to the liquid-crystal film and by switching the voltage on or off, poles of liquid crystals are oriented, so that the liquid-crystal film becomes opaque or transparent. As a result, it is possible to make a glass element (for example a glass window or glass door) transparent or opaque.

When the glass element is moved from a first position (for example a closed position) to a second position (for example an open position), the glass element is pivoted, for example, about a first axis. This may result in lines which are used for activating and/or supplying power to the liquid-crystal film, being distorted (for example being twisted) and possibly tearing.

SUMMARY OF THE INVENTION

The invention is based on the object of specifying a closure element (in particular a door or a window) which can be easily opened and closed on the one hand and, on the other hand, allows sufficiently effective activation of a liquid-crystal film which is contained in the closure element.

According to the invention, this object is achieved by a closure element comprising the features of claim 1. An articulation axis mechanism according to the invention is given by the features of claim 14. A further closure element according to the invention is given by the features of claim 17. Further features of the invention can be gathered from the following description, the appended claims and/or the appended drawings.

The closure element according to the invention has at least one first transparent pane element and at least one second transparent pane element. At least one liquid-crystal film, which can be activated, is arranged between the first transparent pane element and the second transparent pane element. The liquid-crystal film, which can be activated, is laminated onto the first transparent pane element and/or the second transparent pane element for example. However, the invention is not restricted to this manner of fastening. Rather, any manner of fastening with which the liquid-crystal film can be fastened to the first transparent pane element and/or the second transparent pane element is suitable for the invention. The first transparent pane element and/or the second transparent pane element are/is in the form of a glass element/glass elements for example. However, it is explicitly pointed out that the invention is not restricted to the use of glass elements. Rather, any element in which a liquid-crystal film can be used, for example a plastic element, in particular a Plexiglas element, is suitable for the invention.

The closure element according to the invention has at least one articulation axis mechanism. The articulation axis mechanism serves to arrange the closure element in an articulated manner on a component, for example a floor of a room or of a device or, for example, a floor panel of a room or of a device. The articulation axis mechanism has at least one articulation axis element and at least one retaining element, wherein the closure element can be rotated about a first axis of the articulation axis mechanism. The closure element can be moved from a first position (for example an open position) to a second position (for example a closed position) by rotation about the first axis for example. The articulation axis element is arranged on the retaining element. The articulation axis element is, for example, screwed to the retaining element. However, any other manner of arrangement which is suitable for arranging the articulation axis element on the retaining element can also be provided.

The retaining element is arranged between the first transparent pane element and the second transparent pane element. The retaining element is, for example, adhesively bonded or laminated to the first transparent pane element and/or to the second transparent pane element. In addition to or as an alternative to this, provision is made for the retaining element to be held in a clamping manner between the first transparent pane element and the second transparent pane element.

In the closure element according to the invention, provision is further made for the articulation axis element to have at least one opening for at least one first electrical line to pass through. Furthermore, the articulation axis element has at least one receiving unit and at least one electrical connecting element for electrically connecting the first electrical line to a second electrical line, wherein the electrical connecting element is arranged in the receiving unit. The electrical connecting element has at least one first connecting unit and at least one second connecting unit, wherein the second connecting unit is designed such that it can be rotated relative to the first connecting unit about a second axis. The second connecting unit is fixedly arranged on the receiving unit in order to prevent relative movement of the second connecting unit in relation to the receiving unit.

In the closure element according to the invention, provision is also made for the first connecting unit to have at least one first contact element which is connected to at least one first sliding contact and on which the first electrical line is arranged. Furthermore, the second connecting unit has at least one second contact element which is connected to at least one second sliding contact and on which the second electrical line is arranged. The first sliding contact is arranged on the second sliding contact, and the second electrical line is connected to the liquid-crystal film.

The invention is based on the surprising finding that the described design of the closure element according to the invention (in particular a door or a window) ensures that the closure element can be easily opened and closed on the one hand and, on the other hand, allows sufficiently effective activation of the liquid-crystal film which is received in the closure element. Distortion and tearing-off of lines, as in the case of the prior art, cannot occur. The articulation axis element is incorporated, for example, into the floor of a device or the floor of a room and then forms the articulation axis about which the closure element is designed such that it can be rotated.

The closure element is in the form of, for example, a cabinet door, in particular in the form of a refrigerator door. However, the closure element according to the invention is not restricted to this. Rather, the closure element according to the invention can be used anywhere that it is suitable for serving as a closure element, for example for separating off a room. By applying a voltage to the liquid-crystal film and by switching the voltage on or off, poles of liquid crystals are oriented, so that the liquid-crystal film becomes opaque or transparent. As a result, it is possible to make the closure element transparent or opaque. However, it is also possible to display other displays (for example pictures or films) by means of the liquid-crystal film by way of suitable activation.

In an exemplary embodiment of the closure element according to the invention, provision is made, in addition or as an alternative, for the retaining element to have at least one first retaining element part and at least one second retaining element part. The second retaining element part is arranged between the first transparent pane element and the second transparent pane element. In contrast, the first retaining element part is arranged on the articulation axis element. The first retaining element part and the second retaining element part are arranged at an angle, which is different from 0° and 180°, in relation to one another. Therefore, the first retaining element part and the second retaining element part are not arranged parallel in relation to one another. It has been found that this embodiment requires a particularly small amount of installation space and can therefore be easily integrated into a closure element. In a further embodiment, provision is made, in addition or as an alternative, for the angle between the first retaining element part and the second retaining element part to be 90°.

In a further exemplary embodiment of the closure element according to the invention, provision is made, in addition or as an alternative, for the first axis and the second axis to be identical. Therefore, the axis about which the closure element is designed such that it can be rotated and the axis about which the first connecting unit can be rotated relative to the second connecting unit are identical. In an exemplary embodiment, provision is made for the first axis and the second axis to be oriented vertically. However, the closure element according to the invention is not restricted to this orientation. Rather, in the closure element according to the invention, any suitable orientation of the first axis and/or the second axis can be selected.

In a yet further exemplary embodiment of the closure element according to the invention, provision is made, in addition or as an alternative, for the closure element to have at least one third transparent pane element. The third transparent pane element is in the form of, for example, a glass element. However, it is explicitly pointed out that the invention is not restricted to the use of a glass element. Rather, any element, for example a plastic element, in particular a Plexiglas element, is suitable for the third transparent pane element. In the exemplary embodiment, at least one intermediate space for receiving an insulating medium is further arranged between the second transparent pane element and the third transparent pane element. The insulating medium used is, for example, air or another insulating gas. The above-described embodiment is suitable, in particular, for closing a refrigerator or a climate-controlled room.

In an exemplary embodiment of the closure element according to the invention, provision is made, in addition or as an alternative, for the second transparent pane element and the third transparent pane element to have at least one cutout in which the articulation axis mechanism is arranged.

In a once again further exemplary embodiment of the closure element according to the invention, provision is made, in addition or as an alternative, for the second transparent pane element to have a first edge, and for the third transparent pane element to have a second edge. At least one spacer is arranged between the second transparent pane element and the third transparent pane element, said spacer not adjoining the first edge and not adjoining the second edge. It is possible to form the abovementioned intermediate space by using a plurality of spacers. The region between the spacer and the first edge or the second edge can then be filled, for example, with silicone in such a way that a particularly good esthetic impression is created. The abovementioned embodiment is suitable, for example, particularly for use in a further embodiment of the closure element according to the invention. In this embodiment, provision is made for the second transparent pane element to be designed without a frame, and/or for the third transparent pane element to be designed without a frame. In a further embodiment, provision is made, in addition or as an alternative, for the first transparent pane element to be designed without a frame. In the above text and also in the text which follows, a frameless transparent pane element is intended to be understood to mean a transparent pane element of which the edges are not arranged in a frame. The edges or at least some of the edges of the transparent pane element are therefore freely accessible at least in one position of the closure element (or in all positions of the closure element).

In a once again further exemplary embodiment of the closure element according to the invention, provision is made, in addition or as an alternative, for the retaining element to be fixedly adhesively bonded to the first transparent pane element and/or to the second transparent pane element. In a further exemplary embodiment of the closure element according to the invention, provision is made, in addition or as an alternative, for the retaining element to be laminated to the first transparent pane element and/or to the second transparent pane element.

The invention also relates to an articulation axis mechanism for a closure element in the form of a window or a door, in particular a refrigerator door. The articulation axis mechanism has, for example, at least one or a combination of at least two of the features already mentioned above. In particular, the articulation axis mechanism has at least one articulation axis element and at least one retaining element for arranging the closure element. The articulation axis element is arranged on the retaining element, and the articulation axis element has at least one opening for at least one first electrical line to pass through. The articulation axis element further has at least one receiving unit. At least one electrical connecting element for electrically connecting the first electrical line to a second electrical line is arranged in the receiving unit. The electrical connecting element has at least one first connecting unit and at least one second connecting unit, wherein the second connecting unit is designed such that it can be rotated relative to the first connecting unit about one axis. The second connecting unit is fixedly arranged on the receiving unit in order to prevent relative movement of the second connecting unit in relation to the receiving unit. The first connecting unit has at least one first contact element which is connected to at least one first sliding contact and on which the first electrical line is arranged. The second connecting unit further has at least one second contact element which is connected to at least one second sliding contact and on which the second electrical line is arranged, and wherein the first sliding contact is arranged on the second sliding contact.

In an embodiment of the articulation axis mechanism according to the invention, provision is made, in addition or as an alternative, for the retaining element to have at least one first retaining element part and at least one second retaining element part. The second retaining element part is intended to be arranged on the closure element. The first retaining element part is arranged on the articulation axis element. The first retaining element part and the second retaining element part are arranged at an angle, which is different from 0° and 180°, in relation to one another. The angle is, for example, 90°.

The invention also relates to a further closure element in the form of a door or a window. This further closure element can have at least one of the above features or a combination of at least two of the above features. Provision is made, in particular, for said further closure element according to the invention to have at least one first transparent pane element and at least one second transparent pane element. At least one liquid-crystal film, which can be activated, is arranged between the first transparent pane element and the second transparent pane element. The liquid-crystal film, which can be activated, is, for example, laminated onto the first transparent pane element and/or the second transparent pane element. However, the invention is not restricted to this manner of fastening. Rather, any manner of fastening with which the liquid-crystal film can be fastened to the first transparent pane element and/or the second transparent pane element is suitable for the invention. The first transparent pane element and/or the second transparent pane element are/is in the form of, for example, a glass element/glass elements. However, it is explicitly pointed out that the invention is not restricted to the use of glass elements. Rather, any element in which a liquid-crystal film can be used, for example a plastic element, in particular a Plexiglas element, is suitable for the invention.

The further closure element according to the invention has at least one articulation axis mechanism. The articulation axis mechanism serves to arrange the closure element in an articulated manner on a component, for example a floor of a room or of a device or, for example, a floor panel of a room or of a device. The closure element can be moved from a first position (for example an open position) to a second position (for example a closed position) by rotation about one axis for example.

The articulation axis mechanism of the further closure element has at least one opening for at least one electrical line to pass through. The electrical line is, for example, connected to the liquid-crystal film, which can be activated, for activating the liquid-crystal film, which can be activated. The articulation axis mechanism further has at least one first articulation axis unit and at least one second articulation axis unit. Furthermore, the closure element has at least one third transparent pane element which is arranged at a distance from the second transparent pane element in such a way that an intermediate space is arranged between the second transparent pane element and the third transparent pane element. The first transparent pane element is arranged on the first articulation axis unit and/or on the second articulation axis unit. Provision is further made for the second transparent pane element and the third transparent pane element to be arranged between the first articulation axis unit and the second articulation axis unit.

The invention is based on the surprising finding that the described design of the further closure element according to the invention (in particular a door or a window) ensures that the further closure element can be easily opened and closed on the one hand and, on the other hand, allows sufficiently effective activation of the liquid-crystal film which is received in the closure element. Furthermore, effective insulation is provided, so that the further closure element can be used, in particular, as a cabinet door or refrigerator door. However, the further closure element according to the invention is not restricted to this. Rather, the further closure element according to the invention can be used anywhere that it is suitable for serving as a closure element, for example for separating off a room. By applying a voltage to the liquid-crystal film and by switching the voltage on or off, poles of liquid crystals are oriented, so that the liquid-crystal film becomes opaque or transparent. As a result, it is possible to make the further closure element transparent or opaque. However, it is also possible to display other displays (for example pictures or films) by means of the liquid-crystal film by way of suitable activation.

In one embodiment of the further closure element according to the invention, provision is made, in addition or as an alternative, for a gas or a gas mixture to be arranged in the intermediate space between the second transparent pane element and the third transparent pane element. The gas or the gas mixture is in the form of, for example, an insulating medium. Air or an inert gas is arranged in the intermediate space for example.

In a further embodiment of the further closure element according to the invention, provision is made, in addition or as an alternative, for the liquid-crystal film, which can be activated, to be arranged between a first PVB film and a second PVB film, wherein the abbreviation PVB stands for polyvinyl butyral. The liquid-crystal film, which can be activated, is particularly effectively protected in this way.

In a once again further embodiment of the further closure element according to the invention, provision is made, in addition or as an alternative, for at least one first sealing unit to be arranged between the first articulation axis unit on the one hand and the second transparent pane element and/or the third transparent pane element on the other hand. To this end, provision is made, in addition or as an alternative, for at least one second sealing unit to be arranged between the second articulation axis unit on the one hand and the second transparent pane element and/or the third transparent pane element on the other hand. The first sealing unit and the second sealing unit serve, in particular, to seal off the intermediate space between the second transparent pane element and the third transparent pane element.

In an embodiment of the further closure element according to the invention, provision is made, in addition or as an alternative, for the electrical line to be in the form of a first electrical line. The articulation axis mechanism further has at least one receiving unit. Furthermore, at least one electrical connecting element for electrically connecting the first electrical line to a second electrical line is provided, wherein the electrical connecting element is arranged in the receiving unit. The electrical connecting element has at least one first connecting unit and at least one second connecting unit, wherein the second connecting unit is designed such that it can be rotated relative to the first connecting unit about one axis. The second connecting unit is fixedly arranged on the receiving unit in order to prevent relative movement of the second connecting unit in relation to the receiving unit. The first connecting unit has at least one first contact element which is connected to at least one first sliding contact and on which the first electrical line is arranged. The second connecting unit further has at least one second contact element which is connected to at least one second sliding contact and on which the second electrical line is arranged. The first sliding contact is arranged on the second sliding contact, and the second electrical line is connected to the liquid-crystal film. This embodiment has the advantages which have already been explained further above.

BRIEF DESCRIPTION OF THE DRAWINGS

The invention will be described in greater detail below with reference to exemplary embodiments, in which

FIG. 11A shows a schematic view of a further closure element;

FIG. 11B shows sectional views through parts of the closure element according to FIG. 11A; and FIG. 11C shows a schematic view for illustrating the arrangement of a liquid-crystal film, which can be activated.

DETAILED DESCRIPTION OF THE INVENTION

Figure 1:
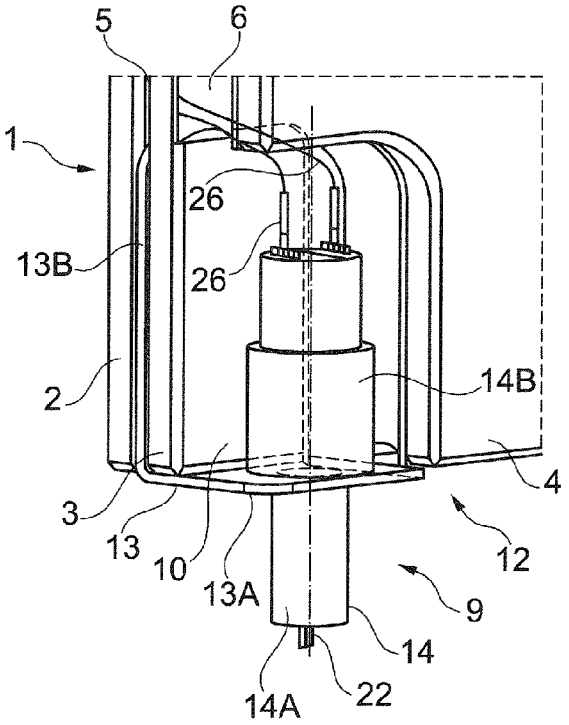
FIG. 1 shows a schematic illustration of a lower region of a closure element in the form of a refrigerator door.
Figure 2:
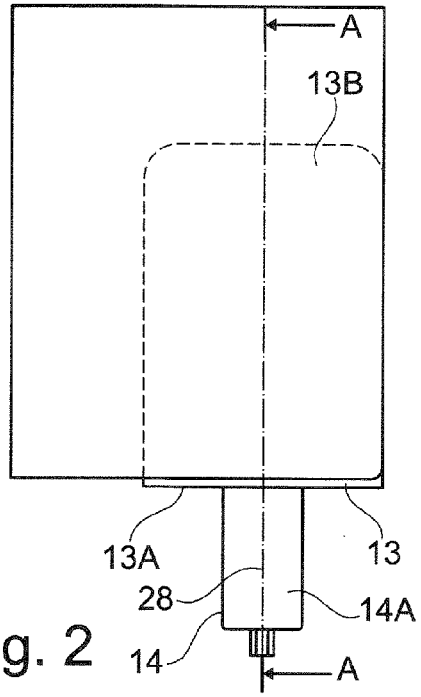
FIG. 2 shows a side view of the closure element according to FIG. 1.
Figure 3:
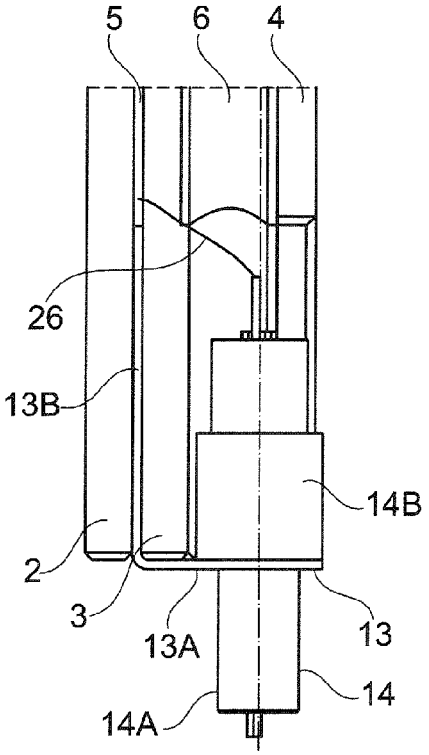
FIG. 3 shows a further side view of the closure element which is rotated through 90° with respect to the side view according to FIG. 2.
Figure 4:
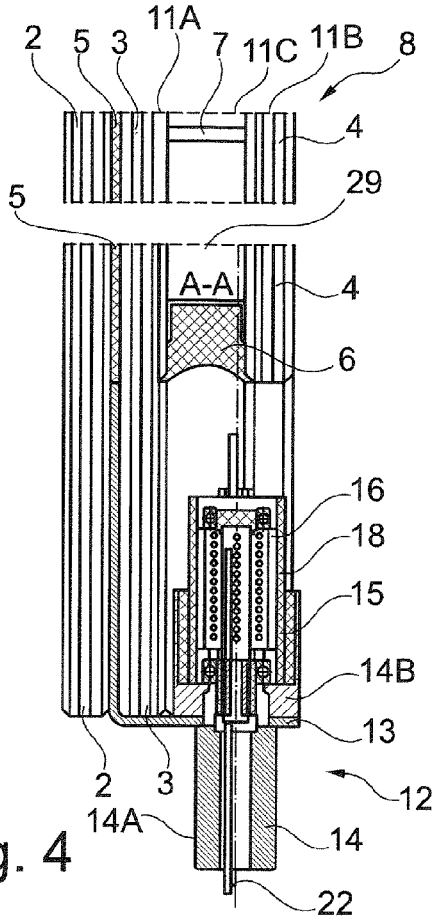
FIG. 4 shows the lower region of the closure element and an upper region of the closure element in a view which is sectioned along line A-A according to FIG. 2.

In the text which follows, reference will first be made to FIGS. 1 to 4. FIG. 1 is a schematic illustration of a lower region 12 of a closure element 1 in the form of a refrigerator door. FIG. 2 is a side view of the closure element 1 according to FIG. 1. FIG. 3 is a further side view which is rotated through 90° with respect to the side view according to FIG. 2. FIG. 4 shows the lower region 12 of the closure element 1 and an upper region 8 of the closure element 1 in a view which is sectioned along line A-A according to FIG. 2. For reasons of clarity, the upper region 8 and the lower region 12 of the closure element 1 are illustrated in a manner in which they are not connected to one another in FIG. 4. However, it is pointed out that the upper region 8 and the lower region 12 of the closure element 1 are connected to one another and therefore form one unit.

The closure element 1 has a first transparent pane element 2, a second transparent pane element 3 and a third transparent pane element 4. All three abovementioned transparent pane elements 2 to 4 are formed from glass. As an alternative to this, at least one of the three abovementioned transparent pane elements 2 to 4 can be formed from another transparent material, for example from Plexiglas. The first transparent pane element 2 is directed toward the outside. The third transparent pane element 4 is directed toward an interior of a refrigerator (not illustrated).

A liquid-crystal film 5, which can be activated, is arranged between the first transparent pane element 2 and the second transparent pane element 3. By applying a voltage to the liquid-crystal film 5 and by switching the voltage on or off, poles of liquid crystals are oriented, so that the liquid-crystal film 5 becomes opaque or transparent. As a result, it is possible to look into the interior of the refrigerator (not illustrated) without opening the closure element 1. The activation of the liquid-crystal film 5 will be discussed in even greater detail further below.

Spacers are arranged between the second transparent pane element 3 and the third transparent pane element 4 in such a way that there is a sealed-off intermediate space 29 between the second transparent pane element 3 and the third transparent pane element 4. The intermediate space 29 is bounded on all sides by spacers. A first spacer 6 in the lower region 12 of the closure element 1 and a second spacer 7 in the upper region 8 of the closure element 1 are illustrated by way of example in FIGS. 1, 3 and 4. All of the spacers, that is to say including the first spacer 6 and including the second spacer 7, are arranged at a distance from a first edge 11A of the second transparent pane element 3 and from a second edge 11B of the third transparent pane element 4. Therefore, the spacers do not adjoin the first edge 11A of the second transparent pane element 3 and do not adjoin the second edge 11B of the third transparent pane element 4. The intermediate region 11C between the spacer (the second spacer 7 in FIG. 4, for example) and the first edge 11A or the second edge 11B can be filled, for example, with silicone in such a way that a particularly good esthetic impression is achieved.

The first transparent pane element 2, the second transparent pane element 3 and the third transparent pane element 4 are designed without a frame in the exemplary embodiment illustrated here. Reference is made to the text further above in respect of the meaning of the term "without a frame".

The intermediate space 29 serves to receive an insulating medium between the second transparent pane element 3 and the third transparent pane element 4. The insulating medium provided is, for example, air or another insulating gas.

An articulation axis mechanism 9 is arranged in a cutout 10 in the second transparent pane element 3 and the third transparent pane element 4. The articulation axis mechanism 9 has a retaining element 13 which is formed from a first retaining element part 13A and a second retaining element part 13B. The first retaining element part 13A and the second retaining element part 13B are arranged at an angle of 90° in relation to one another. The second retaining element part 13B is fixedly arranged between the first transparent pane element 2 and the second transparent pane element 3. The second retaining element part 13B is, for example, fixedly adhesively bonded to the first transparent pane element 2 and laminated to the second transparent pane element 3. However, it should be pointed out that the invention is not restricted to this manner of fastening the second retaining element part 13B. Rather, any suitable manner of fastening can be used.

The first retaining element part 13A has an opening at which an articulation axis element 14 is arranged. The articulation axis element 14 is formed from a first articulation axis element part 14A and a second articulation axis element part 14B. The first articulation axis element part 14A and the second articulation axis element part 14B are screwed to one another, wherein the first articulation axis element part 14A is arranged on that side of the first retaining element part 13A which is directed away from the cutout 10, and wherein the second articulation axis element part 14B is arranged on that side of the first retaining element part 13A which is directed toward the cutout 10.

Figure 5:
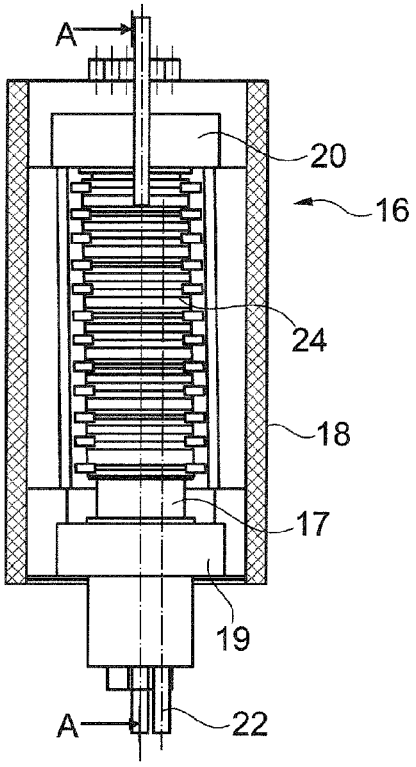
FIG. 5 shows a partially sectioned schematic illustration of an electrical connecting element.
Figure 6:
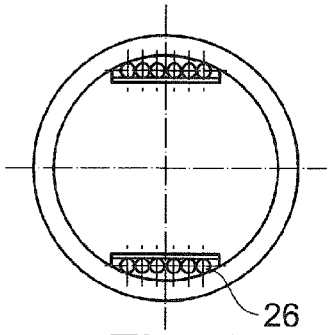
FIG. 6 shows a view of a top face of the electrical connecting element, said view being tilted through 90° in relation to FIG. 5.
Figure 7:
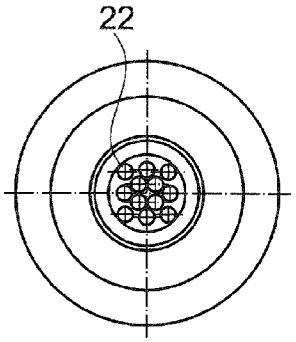
FIG. 7 shows a view of a bottom face of the electrical connecting element, said view being tilted through 90° in relation to FIG. 5.
Figure 8:
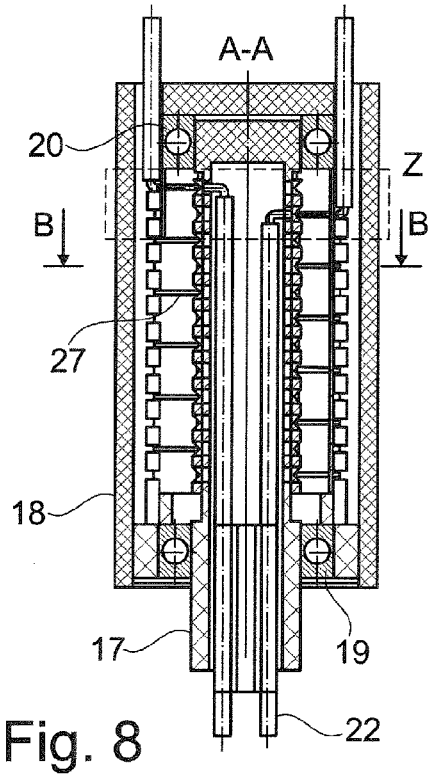
FIG. 8 shows a sectional view through the electrical connecting element along line A-A according to FIG. 5.
Figure 9:
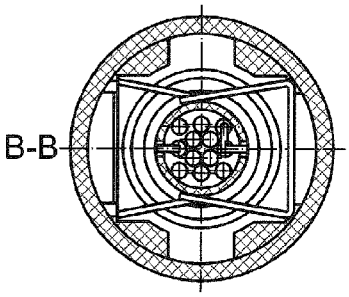
FIG. 9 shows a sectional view through the electrical connecting element along line B-B according to FIG. 8.
Figure 10:
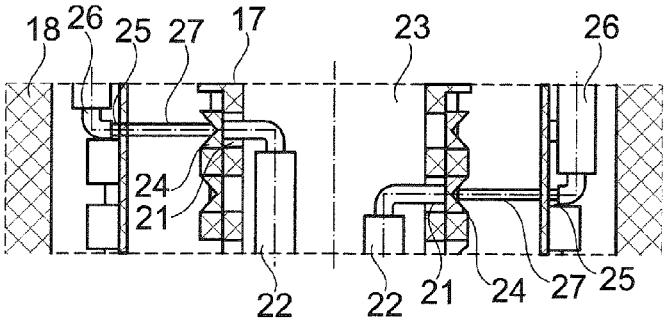
FIG. 10 shows a detail view of the region Z according to FIG. 8.

The second articulation axis element part 14B has a receiving unit 15 in the form of a recess in which an electrical connecting element 16 is arranged. The electrical connecting element 16 is illustrated in greater detail in FIGS. 5 to 10. FIG. 5 shows a partially sectioned schematic illustration of the electrical connecting element 16. FIG. 6 shows a view of the top face of the electrical connecting element 16, which view is tilted through 90° in relation to FIG. 5. In contrast, FIG. 7 shows a view of the bottom face of the electrical connecting element 16, which view is tilted through 90° in relation to FIG. 5. FIG. 8 shows a sectional view through the electrical connecting element 16 along line A-A according to FIG. 5. FIG. 9 shows a sectional view of the electrical connecting element 16 along line B-B according to FIG. 8. FIG. 10 further shows a detail view of the region Z according to FIG. 8.

The electrical connecting element 16 has a first connecting unit 17 and a second connecting unit 18. The second connecting unit 18 is fixedly arranged on the receiving unit 15 (cf. FIG. 4). The second connecting unit 18 is, for example, fixedly adhesively bonded in the receiving unit 15. However, the invention is not restricted to this. Rather, any suitable manner of fastening can be selected in order to fixedly fasten the second connecting unit 18 to the receiving unit 15. The objective is to prevent relative movement of the second connecting unit 18 in relation to the receiving unit 15.

However, the second connecting unit 18 is designed such that it can be rotated relative to the first connecting unit 17. To this end, a first ball bearing 19 is arranged at a first end of the first connecting unit 17 and a first end of the second connecting unit 18. A second ball bearing 20 is further arranged at a second end of the first connecting unit 17 and a second end of the second connecting unit 18.

The first connecting unit 17 has numerous first contact elements 21 on which ends of first electrical lines 22 are respectively arranged. The first electrical lines are routed from the bottom face of the first articulation axis element part 14A, through a hole, into an interior 23 of the first connecting unit 17. In each case one first electrical line 22 is arranged on a first contact element 21. Furthermore, the first connecting unit 17 has numerous first sliding contacts 24 on a side which is directed toward the second connecting unit 18. In each case one first sliding contact 24 is connected to a first contact element 21.

The second connecting unit 18 can be of two-part design. A first part of the second connecting unit 18 and a second part of the second connecting unit 18 encapsulate the first connecting unit 17 in this exemplary embodiment. As an alternative to this, the second connecting unit 18 can be of integral design. The second connecting unit 18 has numerous second contact elements 25 on which ends of second electrical lines 26 are respectively arranged. The second electrical lines 26 are routed from a top face of the second connecting unit 18 to the liquid-crystal film 5. The second electrical lines 26 are connected to the liquid-crystal film 5. The manner in which the second electrical lines 26 are routed can be freely selected in this case. By way of example, the second electrical lines 26 can be routed through a hole in the second transparent pane element 3. As an alternative or in addition to this, provision is made for the second electrical lines 26 to be routed in grooves which are arranged at the edge of the second transparent pane element 3.

In each case one second electrical line 26 is arranged on a second contact element 25. Furthermore, the second connecting unit 18 has numerous second sliding contacts 27 on a side which is directed toward the first connecting unit 17. In each case one second sliding contact 27 is connected to a second contact element 25. In each case one of the first sliding contacts 24 is in sliding contact with in each case one of the second sliding contacts 27.

The first articulation axis element part 14A is incorporated into the floor of a housing (for example a refrigerator housing) such that it can rotate. When the closure element 1 is moved from a first position to a second position by rotation about one axis 28 (cf. FIG. 2), the second connecting unit 18 rotates together with the closure element 1. However, the first connecting unit 17 performs a relative movement in relation to the second connecting unit 18. An adequate electrical connection to the liquid-crystal film 5 is always ensured on account of the first sliding contacts and the second sliding contacts 27. The exemplary embodiment illustrated here further has all of the advantages which have already been mentioned further above.

FIG. 11A shows a schematic view of a further closure element 100 in the form of a refrigerator door. The closure element 100 has a door handle 101. FIG. 11B shows sectional views of parts of the closure element 100, specifically of regions A to C which are identified in FIG. 11A. The region A is the upper region of the closure element 100. The region B is the middle region of the closure element 100. The region C is further the lower region of the closure element 100. FIG. 11C shows a schematic view from above for explaining the arrangement of a liquid-crystal film, which can be activated, which arrangement will be discussed in greater detail further below.

The door handle 101 is arranged on a first transparent pane element 103 by means of a clamping connection 102. The first transparent pane element 103 is, in principle, the front pane of the closure element 100 and is formed, for example, from a single-pane safety glass (SPSG).

The closure element 100 further has a second transparent pane element 107. A liquid-crystal film 104, which can be activated, is arranged between the first transparent pane element 103 and the second transparent pane element 107. A first PVB film 105 is arranged between the first transparent pane element 103 and the liquid-crystal film 104, which can be activated, in order to protect the liquid-crystal film 104, which can be activated. A second PVB film 106 is further arranged between the second transparent pane element 107 and the liquid-crystal film 104, which can be activated.

Furthermore, the closure element 100 has a third transparent pane element 110 which is arranged at a distance from the second transparent pane element 107 in such a way that an intermediate space 111 is arranged between the second transparent pane element 107 and the third transparent pane element 110. In order to ensure a secure arrangement, a first spacer 108 and a second spacer 109 are arranged between the second transparent pane element 107 and the third transparent pane element 110. A gas or a gas mixture is arranged in the intermediate space 111. The gas or the gas mixture is in the form of, for example, an insulating medium. Air or an inert gas is arranged in the intermediate space 111 for example.

The further closure element 100 according to the invention has at least one articulation axis mechanism. The articulation axis mechanism serves to arrange the closure element 100 in an articulated manner on a component, for example a floor of a room or of a device, or for example a floor panel of a room or of a device. The closure element 100 can be moved from a first position (for example an open position) to a second position (for example a closed position) by rotation about one axis for example.

The articulation axis mechanism is provided with a first articulation axis unit 112 and a second articulation axis unit 113. The first articulation axis unit 112 is arranged in the upper region A of the closure element 100. In contrast, the second articulation axis unit 113 is arranged in the lower region C of the closure element 100. The first articulation axis unit 112 and/or the second articulation axis unit 113 are/is in the form of bearings which are composed of VA material for example.

In the exemplary embodiment of the closure element 100 illustrated in FIGS. 11A to 11C, a passage 114 is formed in the second articulation axis unit 113. A first electrical line 115 and a second electrical line 116 are routed through this passage. Said electrical lines are connected to the liquid-crystal film 104, which can be activated, in order to activate the liquid-crystal film 104, which can be activated.

As is particularly clear from FIG. 11B, the first transparent pane element 103 is arranged both on the first articulation axis unit 112 and on the second articulation axis unit 113. Provision is made, for example, for the first transparent pane element 103 to directly adjoin both the first articulation axis unit 112 and the second articulation axis unit 113. The second transparent pane element 107 and the third transparent pane element 110 are further arranged between the first articulation axis unit 112 and the second articulation axis unit 113.

A first sealing unit 117 is arranged between the first articulation axis unit 112 on the one hand and the second transparent pane element 107 and the third transparent pane element 110 on the other hand. In addition, a second sealing unit 118 is arranged between the second articulation axis unit 113 on the one hand and the second transparent pane element 107 and the third transparent pane element 110 on the other hand. The first sealing unit 117 and the second sealing unit 118 serve, in particular, to seal off the intermediate space 111 between the second transparent pane element 107 and the third transparent pane element 110.

The features disclosed in the present description, in the drawings and in the claims may be essential for implementing the invention in its various embodiments both on their own and in any desired combinations.

LIST OF REFERENCE SYMBOLS

1 Closure element
2 First transparent pane element
3 Second transparent pane element
4 Third transparent pane element
5 Liquid-crystal film
6 First spacer
7 Second spacer
8 Upper region
9 Articulation axis mechanism
10 Cutout
11A First edge
11B Second edge
11C Intermediate region
12 Lower region
13 Retaining element
13A First retaining element part
13B Second retaining element part
14 Articulation axis element
14A First articulation axis element part
14B Second articulation axis element part
15 Receiving unit
16 Electrical connecting element
17 First connecting unit
18 Second connecting unit
19 First ball bearing
20 Second ball bearing
21 First contact elements
22 First electrical lines
23 Interior
24 First sliding contacts
25 Second contact elements
26 Second electrical lines
27 Second sliding contacts
28 Axis
29 Intermediate space
100 Closure element
101 Door handle
102 Clamping connection of the door handle
103 First transparent pane element
104 Liquid-crystal film, which can be activated
105 First PVB film
106 Second PVB film
107 Second transparent pane element
108 First spacer
109 Second spacer
110 Third transparent pane element
111 Intermediate space
112 First articulation axis unit
113 Second articulation axis unit
114 Passage
115 First electrical line
116 Second electrical line
117 First sealing unit
118 Second sealing unit
A Region
B Region
C Region
Z Region

The invention claimed is:

1. A closure element (1) in the form of a door or a window, comprising:

at least one first transparent pane element (2), and at least one second transparent pane element (3), wherein:

at least one liquid-crystal film (5), which can be activated, is arranged between the first transparent pane element (2) and the second transparent pane element (3), the closure element (1) has at least one articulation axis mechanism (9), the articulation axis mechanism (9) has at least one articulation axis element (14) and at least one retaining element (13), wherein the closure element (1) can be rotated about a first axis (28) of the articulation axis mechanism (9), the articulation axis element (14) is arranged on the retaining element (13), the retaining element (13) is arranged between the first transparent pane element (2) and the second transparent pane element (3), the articulation axis element (14) has at least one opening for at least one first electrical line (22) to pass through, the articulation axis element (14) has at least one receiving unit (15), at least one electrical connecting element (16) for electrically connecting the first electrical line (22) to a second electrical line (26) is arranged in the receiving unit (15), the electrical connecting element (16) has at least one first connecting unit (17) and at least one second connecting unit (18), wherein the second connecting unit (18) is designed such that it can be rotated relative to the first connecting unit (17) about a second axis (28), the second connecting unit (18) is fixedly arranged on the receiving unit (15) in order to prevent relative movement of the second connecting unit (18) in relation to the receiving unit (15), the first connecting unit (17) has at least one first contact element (21) which is connected to at least one first sliding contact (24) and on which the first electrical line (22) is arranged, the second connecting unit (18) has at least one second contact element (25) which is connected to at least one second sliding contact (27) and on which the second electrical line (26) is arranged, the first sliding contact (24) is arranged on the second sliding contact (27), and the second electrical line (26) is connected to the liquid-crystal film (5), which can be activated.

2. The closure element (1) as claimed in claim 1, wherein:

the retaining element (13) has at least one first retaining element part (13A) and at least one second retaining element part (13B), the second retaining element part (13B) is arranged between the first transparent pane element (2) and the second transparent pane element (3), the first retaining element part (13A) is arranged on the articulation axis element (14), and the first retaining element part (13A) and the second retaining element part (13B) are arranged at an angle, which is different from 0° and 180°, in relation to one another.

3. The closure element (1) as claimed in claim 2, wherein the angle is 90°.

4. The closure element (1) as claimed in claim 1, wherein the first axis (28) and the second axis (28) are identical.

5. The closure element (1) as claimed in claim 1, wherein the first axis (28) and the second axis (28) are oriented vertically.

6. The closure element (1) as claimed in claim 1, wherein:

the closure element (1) has at least one third transparent pane element (4), and at least one intermediate space (29) for receiving an insulating medium is arranged between the second transparent pane element (3) and the third transparent pane element (4).

7. The closure element (1) as claimed in claim 6, wherein the second transparent pane element (3) and the third transparent pane element (4) have at least one cutout in which the articulation axis mechanism (9) is arranged.

8. The closure element (1) as claimed in claim 6, wherein:

the second transparent pane element (3) has a first edge (11A), and the third transparent pane element (4) has a second edge (11B), and at least one spacer (6, 7) is arranged between the second transparent pane element (3) and the third transparent pane element (4), said spacer not adjoining the first edge (11A) and not adjoining the second edge (11B).

9. The closure element (1) as claimed in claim 1, wherein:

the second transparent pane element (3) is designed without a frame, and/or the third transparent pane element (4) is designed without a frame.

10. The closure element (1) as claimed in claim 1, wherein the first transparent pane element (2) is designed without a frame.

11. The closure element (1) as claimed in claim 1, wherein:

the retaining element (13) is fixedly adhesively bonded to the first transparent pane element (2) and/or to the second transparent pane element (3); and/or the retaining element (13) is laminated to the first transparent pane element (2) and/or to the second transparent pane element (3).

12. The closure element (1) as claimed in claim 1, wherein at least one of the following features is provided:

the closure element (1) is in the form of a refrigerator door;

the closure element (1) is in the form of a door to a room or a building;

the first transparent pane element (2) is formed from glass; or the second transparent pane element (3) is formed from glass.

13. The closure element (1) as claimed in claim 6, wherein the third transparent pane element (4) is formed from glass.

14. An articulation axis mechanism (9) for a closure element (1) in the form of a door or a window, comprising:

at least one articulation axis element (14) and comprising at least one retaining element (13) for arranging the closure element (1), wherein:

the articulation axis element (14) is arranged on the retaining element (13), the articulation axis element (14) has at least one opening for at least one first electrical line (22) to pass through, the articulation axis element (14) has at least one receiving unit (15), at least one electrical connecting element (16) for electrically connecting the first electrical line (22) to a second electrical line (26) is arranged in the receiving unit (15), the electrical connecting element (16) has at least one first connecting unit (17) and at least one second connecting unit (18), wherein the second connecting unit (18) is designed such that it can be rotated relative to the first connecting unit (17) about one axis (28), the second connecting unit (18) is fixedly arranged on the receiving unit (15) in order to prevent relative movement of the second connecting unit (18) in relation to the receiving unit (15), the first connecting unit (17) has at least one first contact element (21) which is connected to at least one first sliding contact (24) and on which the first electrical line (22) is arranged, the second connecting unit (18) has at least one second contact element (25) which is connected to at least one second sliding contact (27) and on which the second electrical line (26) is arranged, and the first sliding contact (24) is arranged on the second sliding contact (27).

15. The articulation axis mechanism (9) as claimed in claim 14, wherein:

the retaining element (13) has at least one first retaining element part (13A) and at least one second retaining element part (13B), the second retaining element part (13B) is intended to be arranged on the closure element (1), the first retaining element part (13A) is arranged on the articulation axis element (14), and the first retaining element part (13A) and the second retaining element part (13B) are arranged at an angle, which is different from 0° and 180°, in relation to one another.

16. The articulation axis mechanism (9) as claimed in claim 15, wherein the angle is 90°.

17. A closure element (100) in the form of a door or a window, comprising:

at least one first transparent pane element (103), and at least one second transparent pane element (107), wherein:

at least one liquid-crystal film (104), which can be activated, is arranged between the first transparent pane element (103) and the second transparent pane element (107), the closure element (100) has at least one articulation axis mechanism (112, 113), the articulation axis mechanism has at least one opening (114) for at least one electrical line (115, 116) to pass through, the articulation axis mechanism has at least one first articulation axis unit (112) and at least one second articulation axis unit (113), the closure element (100) has at least one third transparent pane element (110) which is arranged at a distance from the second transparent pane element (107) in such a way that an intermediate space (111) is arranged between the second transparent pane element (107) and the third transparent pane element (110), the first transparent pane element (103) is arranged on the first articulation axis unit (112) and/or on the second articulation axis unit (113), and the second transparent pane element (107) and the third transparent pane element (110) are arranged between the first articulation axis unit (112) and the second articulation axis unit (113).

18. The closure element (100) as claimed in claim 17, wherein a gas or a gas mixture is arranged in the intermediate space (111).

19. The closure element (100) as claimed in claim 17, wherein the liquid-crystal film (104), which can be activated, is arranged between a first PVB film (105) and a second PVB film (106).

20. The closure element (100) as claimed in claim 17, wherein:

at least one first sealing unit (117) is arranged between the first articulation axis unit (112) on the one hand and the second transparent pane element (107) and/or the third transparent pane element (110) on the other hand, and/or at least one second sealing unit (118) is arranged between the second articulation axis unit (113) on the one hand and the second transparent pane element (107) and/or the third transparent pane element (110) on the other hand.

21. The closure element (100) as claimed in claim 17, wherein the electrical line is a first electrical line, and the closure element additionally has the following features:

the articulation axis mechanism has at least one receiving unit;

at least one electrical connecting element for electrically connecting the first electrical line to a second electrical line is arranged in the receiving unit, the electrical connecting element has at least one first connecting unit and at least one second connecting unit, wherein the second connecting unit is designed such that it can be rotated relative to the first connecting unit about one axis, the second connecting unit is fixedly arranged on the receiving unit in order to prevent relative movement of the second connecting unit in relation to the receiving unit, the first connecting unit has at least one first contact element which is connected to at least one first sliding contact and on which the first electrical line is arranged, the second connecting unit has at least one second contact element which is connected to at least one second sliding contact and on which the second electrical line is arranged, the first sliding contact is arranged on the second sliding contact, and the second electrical line is connected to the liquid-crystal film, which can be activated.

* * * * *